United States Patent [19]

Signorelli

[11] Patent Number: 4,676,084

[45] Date of Patent: Jun. 30, 1987

[54] PROTECTING AND SEALING CAP

[76] Inventor: John A. Signorelli, 2150 E. 29th St., Brooklyn, N.Y. 11229

[21] Appl. No.: 853,193

[22] Filed: Apr. 17, 1986

[51] Int. Cl.[4] ..... E05B 39/02

[52] U.S. Cl. ..... 70/440; 70/50; 70/455

[58] Field of Search ..... 70/50, 20, 455, 423–428, 70/439–440; 292/307 B, 307 R, 316, 326

[56] References Cited

U.S. PATENT DOCUMENTS

| | | | |
|---|---|---|---|
| 1,659,433 | 2/1928 | Kroll | 70/50 |
| 1,887,557 | 11/1932 | Keidl | 292/307 B |
| 2,033,371 | 3/1936 | Benaggio | 292/307 B |
| 2,319,753 | 5/1943 | Smith | 70/50 |
| 3,572,063 | 3/1971 | Foote | 70/50 |
| 3,714,802 | 2/1973 | Morse | 70/50 |
| 3,863,468 | 2/1975 | Bach | 292/307 B |
| 4,276,988 | 7/1981 | Kimm | 292/307 B |
| 4,286,640 | 9/1981 | Knox | 292/307 B |
| 4,428,211 | 1/1984 | Hermann | 70/455 |

FOREIGN PATENT DOCUMENTS

| | | | |
|---|---|---|---|
| 573770 | 4/1933 | Fed. Rep. of Germany | 70/50 |

*Primary Examiner*—Robert L. Wolfe

*Attorney, Agent, or Firm*—Brooks Haidt Haffner & Delahunty

[57] ABSTRACT

Protecting and sealing cap for the open end of a ferrule, such as a ferrule at the key receiving end of a lock, with a pair of opposed openings through the wall thereof. The cap is cup-shaped with a tubular wall for encircling the ferrule and an end wall at one end of the tubular wall. A stem projects from the end wall toward the opposite end of the tubular wall and engages with a retainer inserted through the ferrule openings so that the cap cannot be removed without fracturing the cap or the retainer. Several stem, cap and retainer configurations are disclosed, and the retainer may be secured to the cap by a flexible cord.

34 Claims, 29 Drawing Figures

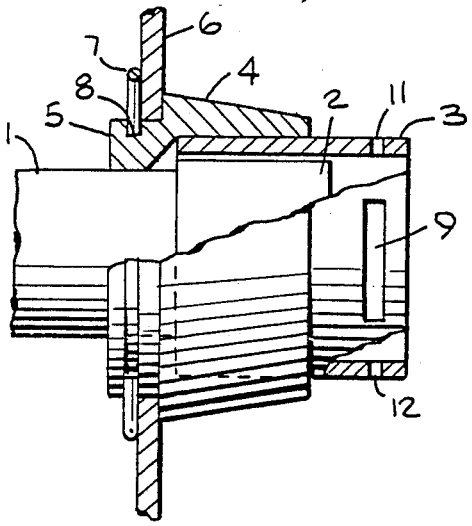
Fig. 1.
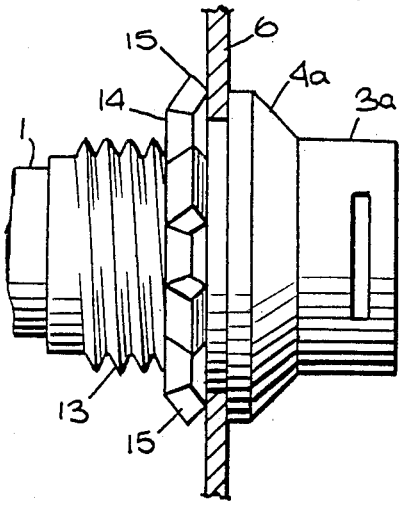
Fig. 2.
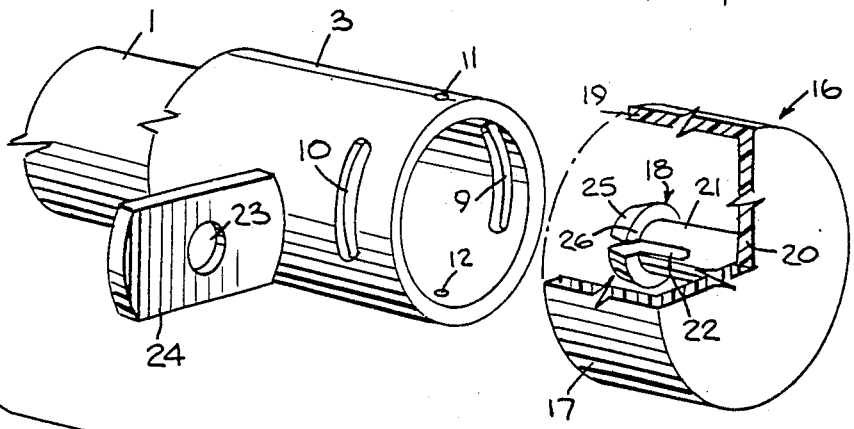
Fig. 3.
Fig. 4.
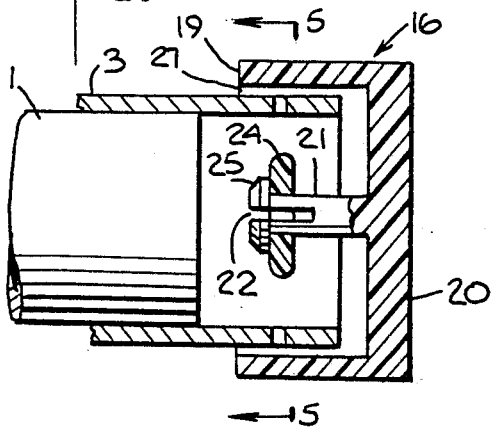
Fig. 5.
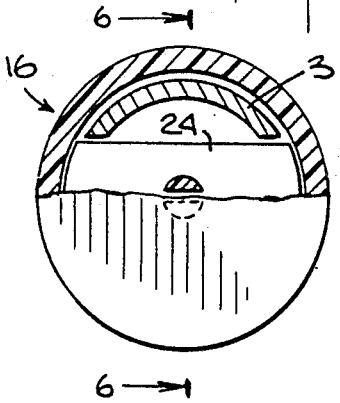

Fig. 6.
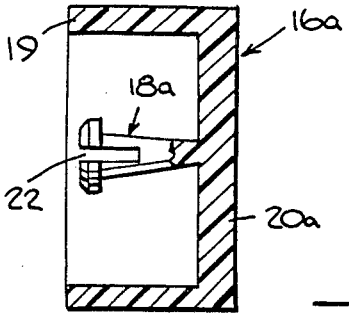
Fig. 7.
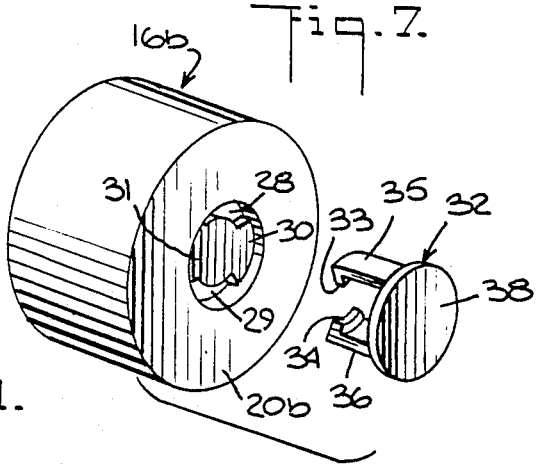
Fig. 11.
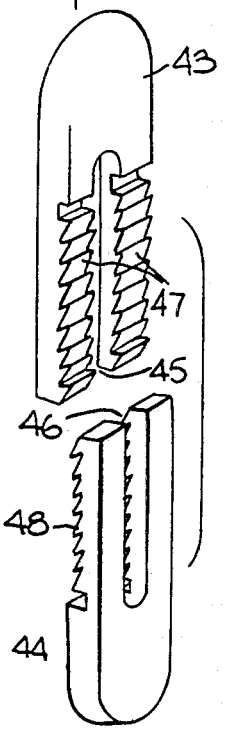
Fig. 9.
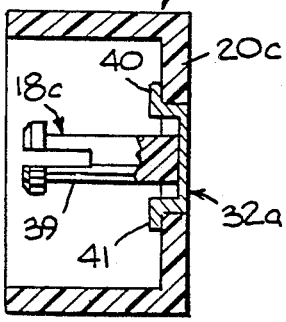
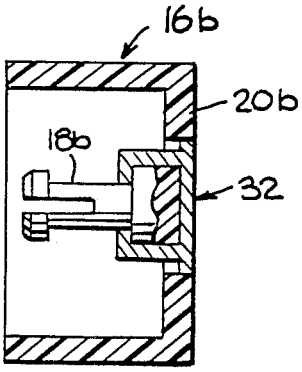
Fig. 8.
Fig. 10.
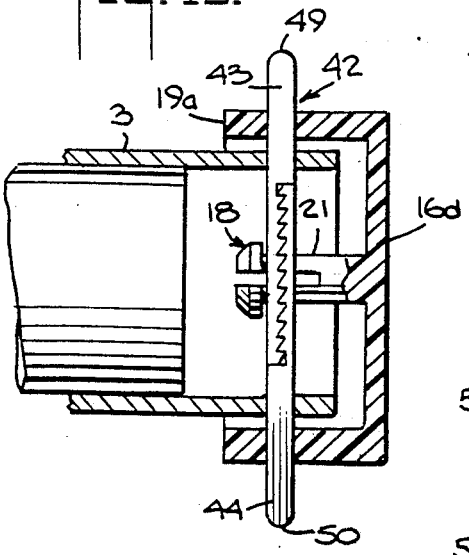
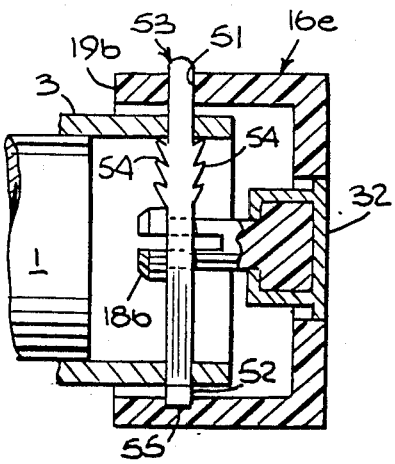
Fig. 12.
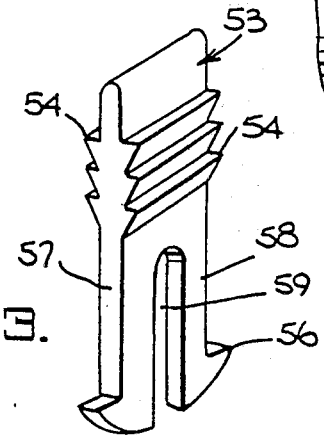
Fig. 13.

PROTECTING AND SEALING CAP

This invention relates to a self-contained protecting and sealing cap for covering the open end of a tubular body and particularly, to a protecting and sealing cap for making secure the lock receiving end of security hardware, and for also preventing access to the key receiving end of a lock unless a portion of the cap is broken or destroyed in a manner which will prevent reuse thereof.

Although the cap of the invention has other uses, such as for protecting and sealing other tubular and non-tubular bodies of devices, access to the interior of which is to be indicated, the cap of the invention will be described in connection with the protection and sealing of a ferrule at its open end for preventing unauthorized access to equipment which is secured by a lock, but it is to be understood that the cap of the invention can be used for protecting and sealing a ferrule with opposed openings in its wall and associated with other devices.

Locks are commonly used to prevent unauthorized access to various types of equipment. In particular, utility companies use such locks in large numbers to prevent unauthorized access to current transformer cabinets, meter enclosures, solid state metering devices, gas cocks, etc. See, for example, U.S. Pat. Nos. 4,313,319 and 4,024,740.

The lock itself may be of any desired type and the key receiving end may have a ferrule with holes or slots in the portion thereof which extends outwardly from the key receiving end, as illustrated in said Patents, or may be provided with such a ferrule as a separate component for use with security hardware. See, for example, U.S. Pat. Nos. 4,391,110 and 4,519,225. Normally, the wire of a wire seal is threaded through said holes after the lock is installed, and the free ends of the wire are sealed together by a lead disk so that access to the lock cannot be had without breaking the wire or the seal. Such sealing of the access end of the lock is not entirely satisfactory not only because unauthorized persons are quite ingenius in duplicating the seal or concealing the break in the seal, and thereby use the same seal, but also because the locks are often installed where they are subject to contamination by dirt, moisture, insect nesting, etc. In addition, the wire seal leaves large openings in the ferrule which permit insects and contaminants to enter the key receiving opening of the lock. The protecting and lockable sealing cap of the invention overcomes the disadvantages of the prior art wire seals and may be used with the already installed, prior art lock ferrules or with such a ferrule which may be added to lock installations which do not have such a ferrule therewith.

One object of the invention is to provide a self-contained, lockable sealing cap for the open end of a tubular member which both prevents access to the interior of the tubular member unless a portion of the cap is ruptured and prevents the ingress of contaminants into the interior of the tubular member.

A second object of the invention is to provide a self-contained, lockable sealing cap for securing the entrance of a ferrule for use with locks or other type fasteners.

A third object of the invention is to provide a self-contained, lockable sealing cap that requires no tools or instruments for its installation or more importantly for its removal.

Another object of the invention is to provide a cap which is lockable and to which there is no access for unlocking it without destroying the cap and thereby making it non-reusable.

Other objects and advantages of the present invention will be apparent from the following detailed description of the presently preferred embodiments thereof, which description should be considered in conjunction with the accompanying drawings in which:

FIG. 1 is a side elevation view partly broken away, of one manner of mounting a ferrule with a housing extending over the key receiving end of a lock;

FIG. 2 is a side elevation view of an alternative embodiment for the mounting of a ferrule with a housing extending over the key receiving end of a lock;

FIG. 3 is an exploded, perspective view, partly in cross-section, of an embodiment of the security cap of the invention with the ferrule's housing omitted;

FIGS. 4 and 5 are respectively, side elevation and end views, partly in cross-section, of the security cap and ferrule shown in FIG. 3;

FIG. 6 is an axial cross-section of a cap of the invention;

FIG. 7 is an exploded, perspective view of a modified form of the cap of the invention;

FIG. 8 is an axial cross-section of the embodiment o cap shown in FIG. 7;

FIG. 9 is an axial cross-section of a modification of the embodiment illustrated in FIG. 8;

FIG. 10 is an axial cross-section of a modified embodiment of the invention;

FIG. 11 is a perspective view of the retainers employed in the embodiment illustrated in FIG. 9;

FIG. 12 is an axial cross-section of a modified embodiment of the invention;

FIG. 13 is a perspective view of the retainer employed in the embodiment illustrated in FIG. 12;

Figure 14:
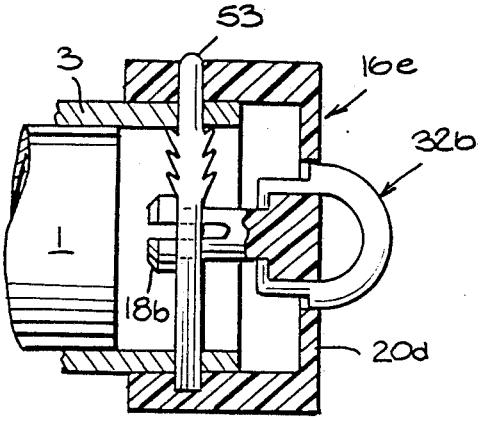
FIG. 14 is an axial cross-section of a further modified embodiment of the invention.

If the lock to be protected already has a ferrule around the key receiving end, as illustrated in said U.S. Pat Nos. 4,024,740 and 4,313,319, the protecting and sealing cap of the invention may be applied to such ferrule in the manner hereinafter described. However, if the lock does not have such a ferrule therewith, a ferrule may be provided at the key receiving end of the lock as illustrated in FIGS. 1 and 2. Although the invention will be described in connection with the use of a ferrule with a "barrel" type lock, it will be apparent that the invention is applicable for the protection and sealing of other types of locks, such a cylinder type which are used in doorways, gates, etc.

FIG. 1 illustrates a barrel type lock with as body 1 having a head 2 which fits within a ferrule 3 having a press fit or permanent fit within a housing 4. A reduced size end portion 5 of the housing 4 passes through an opening in a panel 6 of the equipment to be protected, and the housing 4 is retained on the panel 6 by a hair-pin type retainer clip 7 which fits into a groove 8 on the housing 4. Of course, other known types of retainers may be substituted for the retainer clip 7.

The ferrule 3 has a pair of opposed slots 9 and 10 in the wall thereof (FIGS. 1 and 3) and a pair of opposed holes 11 and 12 disposed 90 degrees from the centers of the slots 9 and 10. With the cap of the invention, the holes 11 and 12 in the ferrule 3 may be omitted.

FIG. 2 illustrates a modified form of the ferrule and housing which may be installed in a panel 6. The housing 4*a* is integral with a ferrule portion 3*a* and has a threaded portion 13 which fits through an opening in the panel 6. The housing 4*a* is retained on the panel 6 by a nut 14 having peripheral teeth 15 which "bite" into the panel 6 when the nut 14 is tightened so as to resist loosening of the nut 14.

In the description given hereinafter, the ferrule 3 or 3*a* will be shown without a housing 4 or 4*a* because, as pointed out hereinbefore, the sealing cap of the invention is applicable to a ferrule protruding in front of and over a lock head 2, or other security device or fastener, whether the ferrule is separably mounted as illustrated in FIGS. 1 and 2, is secured to the lock itself or is otherwise mounted and captured by the lock head 2.

The ferrule 3 illustrated in FIG. 3 and in later figures is intended to represent the ferrule 3 of FIG. 1, the ferrule portion 3*a* of FIG. 2 or any ferrule associated with the key receiving end of a lock or a pipe end or other tubular or non-tubular device which has slots or other openings to secure the lockable sealing cap.

In the embodiment illustrated in FIGS. 3–5, the protecting and sealing cap 16 of the invention comprises a cup-shaped portion 17 with an integral stem or prong 18 disposed centrally of the inside of the portion 17. The portion 17 has a circular, tubular wall 19 and a frangible end wall 20. For corrosion prevention and ease of manufacture, the cup 16 preferably is made of a plastic material which will rupture with bending of the wall 20 when the latter is pushed or pulled for removal.

The stem 18 has a cylindrical portion 21 with an end slot 22 which permits the portions at the opposite sides of the slot 22 to move toward each other when the head portion 25 of the stem 18 is inserted through an opening 23 in a retainer 24 as described hereinafter. The head portion 25 has a lip 26 and is sufficiently compressible and elastic to permit it to pass through the opening 23 and thereafter, to return to its normal size.

Although the inner diameter of the wall 19 of the cap 16 may be only large enough to permit the cap 16 to fit over the ferrule 3, the exterior diameters of ferrules are of various sizes, and therefore, it is desirable to make the inner diameter of the wall 19 large enough to permit the cap 16 to fit over ferrules of several sizes. In the embodiments illustrated in FIGS. 3–12, it will be assumed that the cap 16 fits over a ferrule 3 of a smaller exterior diameter so that after the cap 16 is placed over a ferrule 3, as illustrated in FIG. 4, there is a space 27 of small radial dimension between the inner surface of the wall 19 and the outer surface of the ferrule 3.

To install the cap 16 on a ferrule 3, the retainer 24 is inserted in the slots 9 and 10 so that the opening 23 is concentric with the axis of the ferrule 3. In this position of the retainer 24, the opposite ends thereof are a distance apart which is smaller than the inner diameter of the cap 16 and greater than the outer diameter of the ferrule 3. The cap 16 is then placed over the end of the ferrule 3 with insertion of the head portion 25 through the opening 23. The length of the stem 18 is selected so that the head portion 25 passes through the opening 23 of the retainer 24 and the lip 26 is engageable with the side of the retainer 24 remote from the end wall 20 before the end wall 20 engages the end of the ferrule 3 as illustrated in FIG. 4. As the head portion 25 passes through the opening 23, the head portion 25 is compressed, and after the head portion passes through the opening 23, it "snaps" back to its uncompressed size.

After the cap 16 is installed, the caps tubular wall 19 covers the retainer 24 and the slot openings 9 and 10 and it can be rotated about the ferrule's axis. The protecting and sealing cap's locking mechanism is thereby concealed and unobvious after installation of the cap 16.

Once the cap 16 is installed, it is rotatable and locked in place, but as described, it cannot be removed without breaking either the retainer 24 or some portion of the cap 16. Preferably, the strength of the retainer 24 is selected so that the retainer 24 will not break before a portion of the cap 16 breaks. Thus, if someone attempts to remove the cap 16 by pulling or prying it, a portion of the cap 16 will fracture. Preferably, the strength and dimensions of the end wall 20 are selected so that it will break first when an attempt to pull or pry the cap 16 off the ferrule 3 is made or when the end wall 20 is pushed toward the lock body 1 with a force in excess of the force required to install the cap 16 initially. Thus, when an attempt is made to remove the cap 16, the cap will be damaged beyond repair and will be rendered non-reusable.

If it is desired to have the stem 18 separate from the end wall 20 when an attempt is made to remove the cap 16 from the ferrule 3, the stem may be tapered, as illustrated in FIG. 6, so as to weaken it where it joins the end wall 20*a* and/or at the slot 22. The cap 16*a* shown in FIG. 6 is like the cap 16 shown in FIGS. 3–5 except for the tapered stem 18*a*.

The connection of the stem to the cap may be further weakened as illustrated in FIGS. 7 and 8. In FIGS. 7 and 8 the cap 16*b* has a pair of slots 28 and 29 in its end wall 20*b* and the stem or prong 18*b* is connected to the cap 16*b* by relatively thin arcuate sections 30 and 31. Preferably, the slots 28 and 29 and the space between the arcuate sections 30 and 31 and the outer surface of the end wall 20*b* are filled by a clip 32 having teeth 33 and 34 on resilient fingers 35 and 36 which engage an enlarged portion 37 at the base of the stem 18*b* so as to prevent removal of the clip 32. Preferably, the clip 32 is made of a material stronger than the material of the cap 16*b*, e.g. of a stronger plastic material or of metal, so that the clip 32 will not be destroyed when a part of the cap 16*b*, e.g., the arcuate sections 30 and 31 are fractured. The clip 32 may have a color different from the color of the cap 16*b* for identification purposes and/or may have identification marks, e.g. numbers or letters, on its end face 38 or elsewhere thereon.

Instead of enlarging the base portion of the stem for the purpose of securing the clip, the stem may have the configuration shown in FIG. 9, and the teeth on the clip may extend outwardly, rather than inwardly, so as to engage the inner surface of the end wall of the cap. As illustrated in FIG. 9, the stem 18*c* has a cylindrical portion 39 which is secured to the cap 16*c* by arcuate sections, not visible in FIG. 9 but like the sections 30 and 31 shown in FIG. 7, and the clip 32*a* has outwardly extending teeth 40 and 41 which engage the inner surface of the end wall 20*c*.

In the embodiments described, the retainer 24 is inserted in the slots 9 and 10 and the cap 16, 16*a*, 16*b* or 16*c* is applied to the ferrule 3. After application of the cap to the ferrule, the cap is rotatable and locked in place. There are no external wires to cut, or manipulate. If desired, the cap and retainer may be constructed as illustrated in FIGS. 10 and 11 so that the retainer may be inserted after the cap is applied to the ferrule and so that the cap is not rotatable after application to the ferrule.

FIGS. 10 and 11 illustrate a cap 16*d* which is the same as the cap 16 (FIGS. 3–5) except for the inclusion of a pair of slots in the wall 19*a* thereof for receiving a retainer 42 having two parts 43 and 44. The parts 43 and 44 have slots 45 and 46 for receiving the cylindrical portion 21 of the stem 18 and are provided with interlocking teeth 47 and 48.

To install the cap 16*d*, it is applied over the ferrule 3 with its slots aligned with the slots 9 and 10 in the ferrule 3. The retainer parts 43 and 44 are then inserted through the slots in the cap 16*d* and in the ferrule 3, with the teeth 47 facing the teeth 48. When inserted and disposed as shown in FIG. 10, the parts 43 and 44 cannot be removed because of the interengagement of the teeth 47 and 48, and the cap 16*d* cannot be removed without fracturing a part. The cap 16*d* also cannot be rotated because of the presence of the parts 43 and 44 in the slots in the wall 19*a*.

Although FIGS. 10 and 11 illustrate relatively long retainer parts 43 and 44 and relatively long slots 45 and 46 and show such parts 43 and 44 extending outwardly of the wall 19*a*, the parts 43 and 44 may be shorter and of a length such that their outer ends 49 and 50 are substantially flush with the outer surface of the wall 19*a* so as to make it difficult to grasp the parts 43 and 44 after they have been installed. Also, the length of the slots 45 and 46 may be selected so that when the parts 43 and 44 are fully inserted, parts 43 and 44 abut the portion 21 of the stem 18 at the ends of the slots 45 and 46.

A further embodiment of the invention is illustrated in FIGS. 12 and 13. The cap 16*e* illustrated in FIG. 12 is essentially the same as the cap 16*b* (FIGS. 7 and 8) except for the addition of a slot 51 and a groove 52 in the wall 19*b* to receive a further embodiment of a retainer 53. The retainer 53 has teeth 54 on opposite sides thereof and a pair of teeth 55 and 56 at the ends of a pair of resilient fingers 57 and 58 separated by a slot 59.

The spacing between outer surfaces of the fingers 57 and 58 is substantially equal to the length of the slot 51, and the lengths of the slots 9 and 10 in the ferrule 3 so that the fingers 57 and 58 move toward each other as the teeth 55 and 56 move through the slots. However, when the retainer 53 is fully in place, the fingers 57 and 58 resume their normal positions, and the teeth 55 and 56 engage the outer surface of the ferrule 3. At the same time, the portion of the retainer at the end of the slot 59 engages the cylindrical portion of the stem 18*b*, and the lower end of the retainer 53 is in the groove 52 of the cap 16*e*.

Although the teeth 55 and 56 may provide sufficient resistance to the removal of the retainer 53, the resistance to removal may be increased by the use of the saw-tooth shaped teeth or barbs 54 which, when the retainer 53 is in place, are engageable with the inner surface of the ferrule 3 and also resist removal of the retainer 53. It is not necessary that teeth 54 be provided at both sides of the retainer 53, and therefore, teeth 54 at one side of the retainer 53 may be omitted. Furthermore, as described hereinafter, the teeth or barbs 54 may be formed in a different manner.

The cap 16*e* and the retainer 53 may be installed on the ferrule 3 in the manner described in connection with the embodiment described in connection with FIGS. 10 and 11. It will be apparent that in both embodiments, removal ofthe cap, 16*d* or 16*e*, is resisted not only by the engagement of the stem, 18 or 18*b*, engaging the retainer, 42 or 53, but also by entry of the retainers into the slots and groove of the cap. Similarly, as with the embodiments described in connection with FIGS. 3–9, a part, such as a part of the cap, must be fractured and destroyed in order to remove the cap from the ferrule 3.

Figure 23:
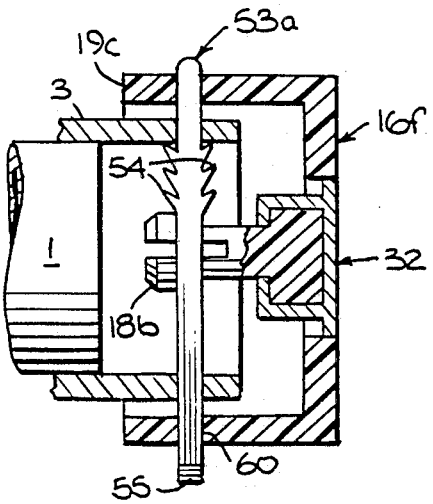
FIG. 23 is a fragmentary cross-section of a modification of the embodiment illustrated in FIG. 12.

A slightly modified form of the embodiment illustrated in FIGS. 12 and 13 is shown in FIG. 23. The embodiment shown in FIG. 23 differs from the embodiment shown in FIGS. 12–13 in that the groove 52 is replaced by a slot 60 in the wall 19*c*of the cap 16*f* and the retainer 53*a* is made longer so as to extend through the slot 60.

FIG. 14 illustrates a further modification of the embodiment shown in FIGS. 12 and 13. FIG. 14 shows a larger diameter ferrule 3 which has a sliding fit with the cap 16*e*, a thinner end wall 20*d* and a domed clip 32*b* which extends outwardly of the outer surface of the end wall 20*d*. Although clips 32 and 32*a* have been illustrated with their outer surfaces flush with the outer surface of the cap end wall, such clips 32 and 32*a* may also protrude from the outer surface of the cap end wall.

Figure 15:
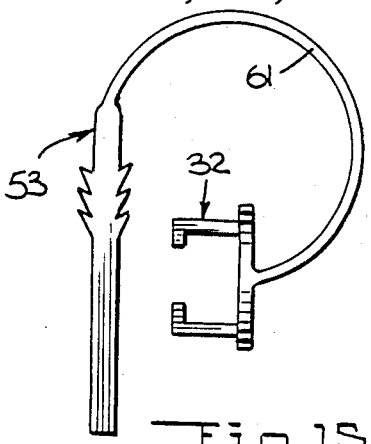
FIG. 15 is a side-elevation view of the retainer and clip shown in FIG. 14 connected together by a flexible cord.

For ease of manufacture and to eliminate the need for, and loss of, individual retainers and clips, the retainers and clips may be secured together by a flexible cord which may be made of the same plastic material as the retainer and clip. FIG. 15 illustrates a clip 32 secured to a retainer 53 by a flexible umbilical cord 61. The umbilical cord 61 may be circular, noncircular, rectangular or polygonal in cross-section. The cord 61 may be provided with a plurality of perforations or indentations extending transversely to the length thereof and/or a plurality of indentations or grooves extending longitudinally of the cord 61 to provide a pattern which will aid in recognition of a cutting and reconstruction of the cord 61. It will be apparent that in the various embodiments employing a clip and a retainer which extends to an exterior surface of a cap, the clip and the retainer may be similarly secured together.

Figure 16:
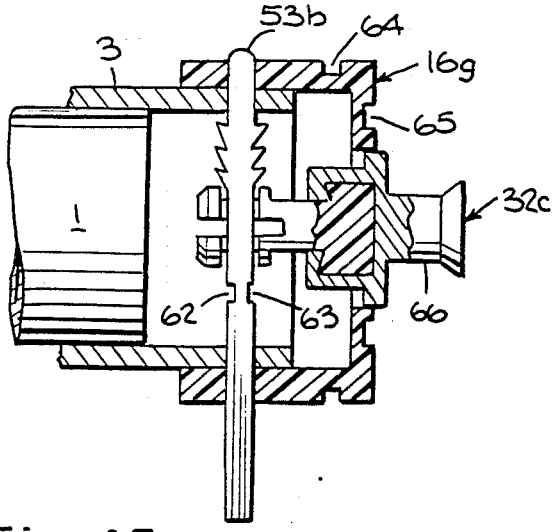
FIG. 16 is an axial cross-section of a further modified embodiment of the invention.

FIG. 16 illustrates an embodiment of the invention which is similar to the embodiments illustrated in FIGS. 12–14 and 23. In the embodiment shown in FIG. 16, the retainer 53*b* has a pair of grooves 62 and 63 for reducing the ability of the retainer 53*b* to resist fracture. The cap 16*g* may also have one or more weakening grooves, such as the peripheral groove 64 and the circular groove 65 to reduce the force required to fracture the cap 16*g*.

FIG. 16 also illustrates a modified clip 32*c* having a handle 66 for ease in removal of the cap 16*g* (with fracture) and for rotating the stem 18*a*–18*c* in those embodiments in which the cap is rotatable.

Figure 17:
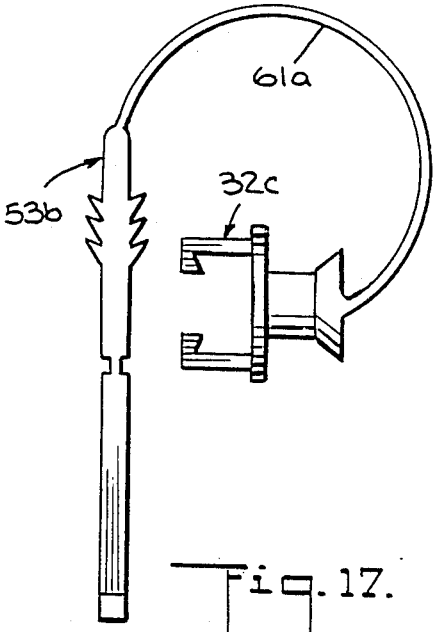
FIG. 17 is a side-elevation view of the retainer and clip shown in FIG. 16 connected together by a flexible cord.

FIG. 17 illustrates the retainer 53*b* secured to the clip 32*c* by a cord 61*a*.

Figure 18:
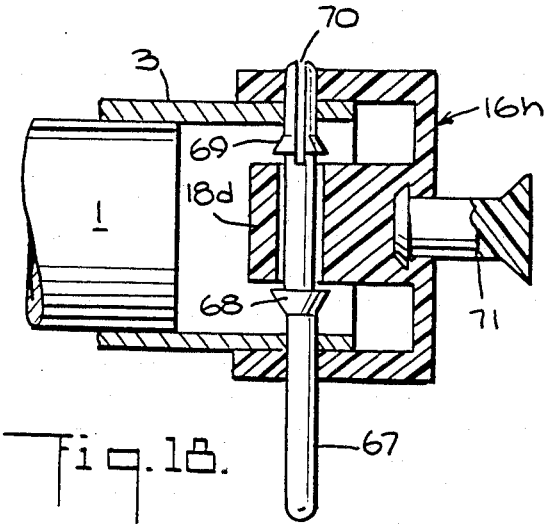
FIGS. 18–22 are axial cross-sections of further modified embodiments of the invention.

FIG. 18 illustrates a further embodiment of the invention in which the retainer 67 is circular or rectangular in cross-section and has a pair of compressible and resilient, peripheral barbs 68 and 69 which are oppositely directed to permit the retainer 67 to be pushed upwardly into the position shown in FIG. 18 but which resist removal of the retainer 67. The retainer 67 has an end slot 70 which aids in compressing the barb 69 during insertion of the retainer 67.

The cap 16*h* and the stem 18*d* have holes therein shaped to receive the retainer 67.

Figure 19:
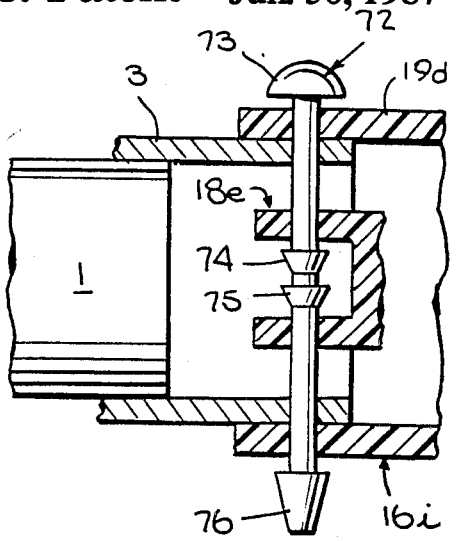

A further modified embodiment of the invention is illustrated in FIG. 19. FIG. 19 shows a rod or bar type retainer 72 with an enlarged end 73 which will not pass through the hole in the tubular wall 19*d* of the cap 16*i*. The retainer has three barbs 74, 75 and 76, although one of the barbs 74 or 75 may be omitted, which permit the retainer 72 to be inserted downwardly into the position shown in FIG. 19 but which resist removal of the retainer 72. The cap 16*i* has a modified stem 18*e* for receiving the barbs 74 and 75.

Figure 20:
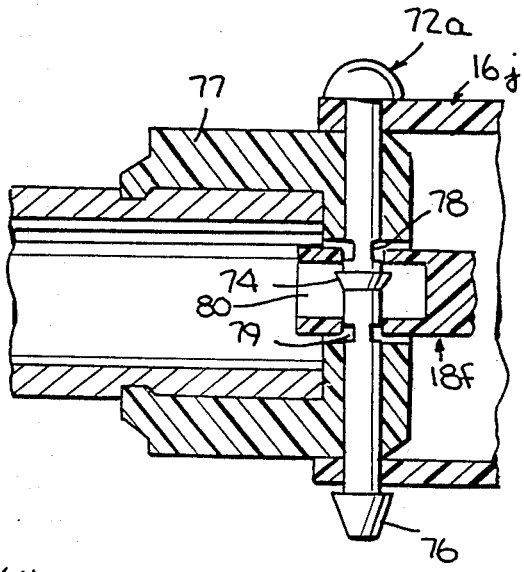

The barb 76 may be arranged to break off the retainer 72 easily if an attempt is made to remove the latter. The retainer 72 may have grooves or necked-down portions, as illustrated in FIG. 20, to cause it to break more readily if an attempt is made to remove the cap 16*i*.

In some cases, the lock may have a head with a hole therethrough for receiving a conventional seal. Insofar as the invention is concerned, such head is the equivalent of a ferrule 3 and may receive a cap and retainer of the invention. FIG. 20 illustrates a lock body 1 with a head 77 having a hole therethrough into which a retainer 72*a*, similar to the retainer 72, is inserted. The retainer 72*a* has weakening grooves 78 and 79 and the barb 74 is received in the tubular bore 80 of the stem 18*f* of the cap 16*j*.

Figure 21:
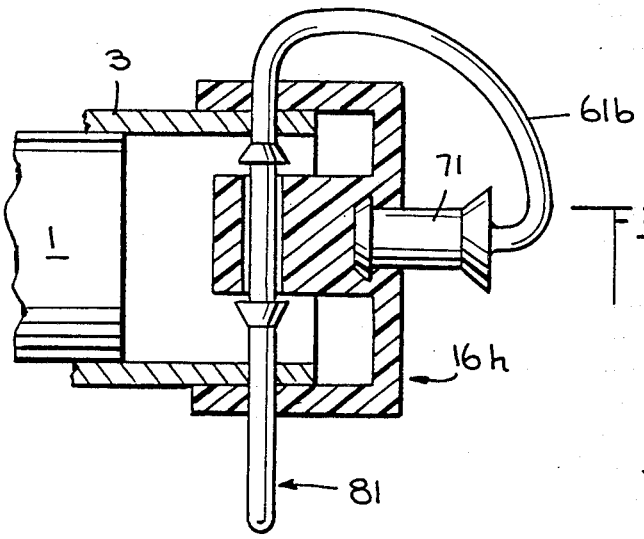

FIG. 21 illustrates the use of the cap 16*h* (FIG. 18), with a retainer 81, similar to the retainer 67 (FIG. 18), secured to the handle 71 by a cord 61*b*.

Figure 22:
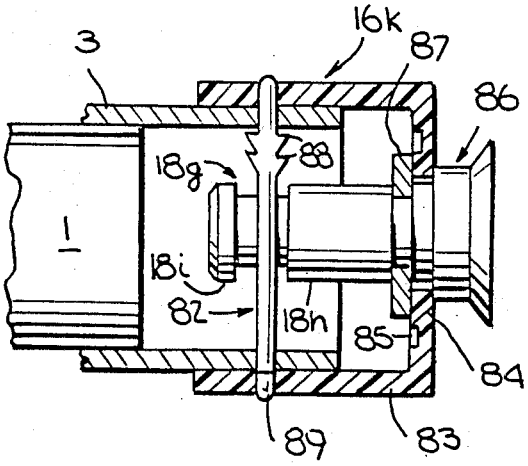

It may be desired, in some cases, to make the stem or prong on the cap separately from the cap, particularly if it is desired to make the prong or stem of a material different from the material of the cap or if it is desired to simplify the molds used to make the cap. FIG. 22 illustrates an embodiment of a cap 16*k* formed in two parts and used with a retainer 82 of the type described in connection with FIGS. 12–14.

The cap 16*k* (FIG. 22) has a cup-shaped portion 83 which may be made of a plastic materials which is relatively easily frangible. If desired, the end wall 84 may have a circular weakening groove 85.

A one piece stem 18*g* and handle 86 is received in an opening in the end wall 84 and is held on the end wall 84 by a conventional retaining ring 87 which provides as relatively large area of contact with the end wall 87 and accordingly, would remove a relatively large area of the end wall 87 when the end wall 87 is fractured by pulling of the handle 86. Of course, the stem 18*g* and the handle 86 may be secured to the cap 16*k* other than by means of the retaining ring 87.

It will be observed that the stem 18*g* shown in FIG. 22 has an enlarged portion 18*h* which is larger than the opening in the retainer 82 and which is spaced from the lip 18*i* by an amount greater, and preferably, substantially equal to, the thickness of the retainer 82. Such enlarged portion 18*h* will engage the retainer 82 when the handle 86 is pushed inwardly of the ferrule 3 and will fracture the retainer 82. A similar enlargement, or an enlarged lip, may be included on the stems illustrated in FIGS. 3–14, 23 and 24 for the same purpose.

As in the embodiment of the retainer illustrated in FIGS. 12–14, the retainer 82 has teeth or barbs 88 and a pair of teeth, tooth 89 being shown in FIG. 22 to resist removal of the retainer 82. The retainer 82 also has a slot, like the slot 59 of the retainer 53 (FIG. 13), for receiving the stem 18*g*. The retainer 82 may be connected to the handle 86 by a cord as illustrated in FIG. 21.

As previously mentioned, one of the objects of the invention is to provide a cap which prevents contaminants from entering the key hole of the lock. With the embodiments described, the entry of contaminants into the key hole will be reduced, as compared to a wire seal, even if there is a small space between the inner surface of the tubular wall of the cap and the exterior surface of the ferrule. However, if desired, a resilient ring shaped member may be inserted between the tubular wall of the cap and the ferrule.

Figure 24:
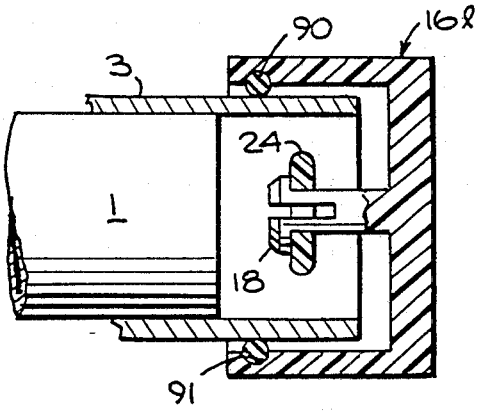
FIG. 24 is an axial cross-section of a modification of the embodiment shown in FIGS. 3–5.

FIG. 24 illustrates the use of a sealing ring 90 with a cap 161 similar to the cap 16 (FIGS. 3–5) but it will be apparent to those skilled in the art that such a ring 90 may be used with the other embodiments of the cap. The ring 90, commonly known as an "O-ring" and made of rubber or other similar compressible and resilient material, is received and retained in a circumferential groove 91 in the tubular wall of the cap 161 and is compressed between the wall of the groove 91 and the outer surface of the ferrule 3 to provide a seal between the cap 161 and the ferrule 3.

Alternatively, the cap may be made without the groove 91, and the ring 90, or a similar sealing member of compressible and resilient material, may be bonded to the inner surface of the exterior wall of the cap to provide the desired seal, such ring 90 or similar sealing member acting in the manner of a gasket.

Figure 25:
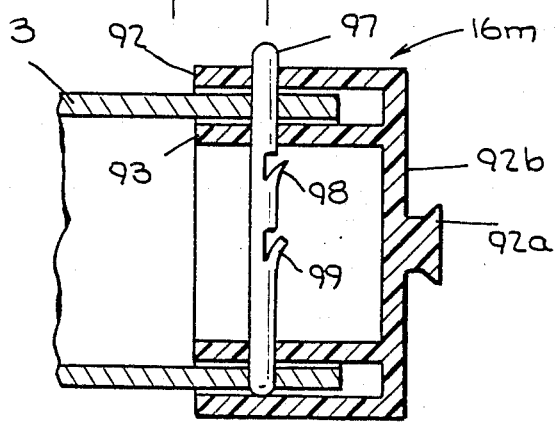
FIG. 25 is an axial cross-section of a modified embodiment of the sealing cap of the invention covering an end of a ferrule.
Figure 26:
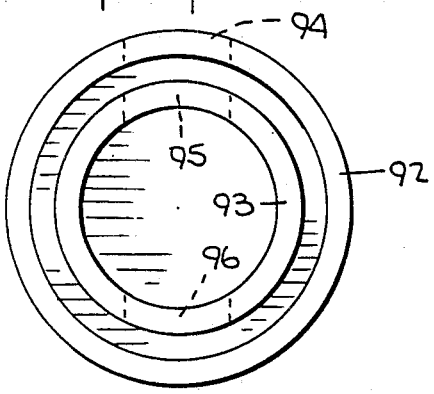
FIG. 26 is an end view of the sealing cap shown in FIG. 25.

FIGS. 25 and 26 illustrate a further embodiment of a cap 16*m*. The cap 16*m* has a pair of concentric tubular walls 92 and 93, the wall 92 extending around the periphery of the ferrule 3, either close or in slightly spaced relation thereto, and the wall 93 being in slightly spaced relation to the interior surface of the ferrule 3. The inner tubular wall 93 acts as a stem and may have a circular section as shown in FIG. 26 or it may comprise a pair of arcuate sections. The tubular walls 92 and 93 have slots 94, 95 and 96 for the passage of a retainer 97 which has a pair of teeth or barbs 98 and 99. The cap 16*m* has a handle 92*a* which is integral with the end wall 92*b* and which is used for purposes described hereinbefore.

Figure 27:
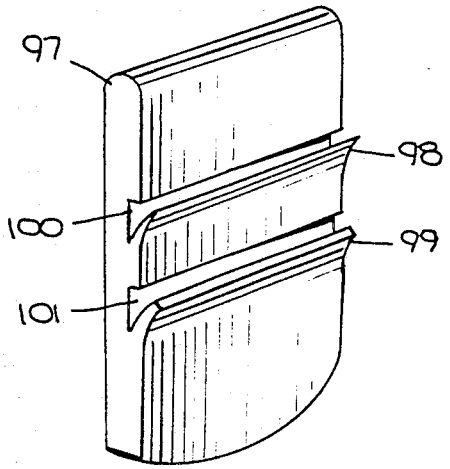
FIG. 27 is an enlarged perspective view of the retainer shown in FIG. 25.

The retainer 97 is shown in enlarged perspective view in FIG. 27, and it will be observed that the teeth or barbs 98 and 99 have cavities 100 and 101 between them and the main body of the retainer 97 into which they fit when they are pressed toward the retainer body during insertion of the retainer 97. Of course, previously described similar retainers may have such cavities for such purpose.

Figure 28:
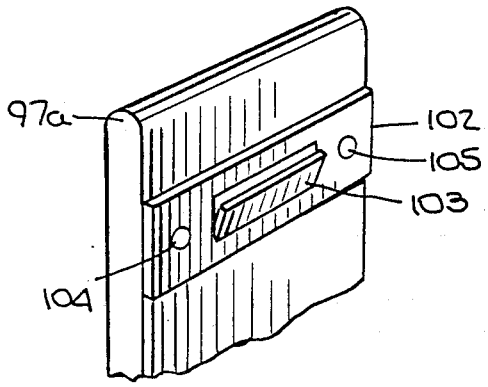
FIGS. 28 and 29 are fragmentary views of modified forms of the retainer shown FIG. 27.
Figure 29:
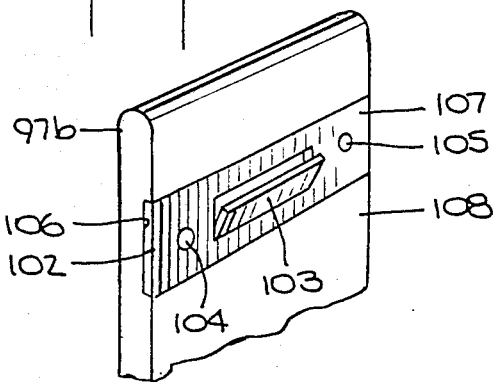

In the various embodiments described hereinbefore, the teeth or barbs for preventing removal of a retainer have been illustrated as integral with the retainer. If it is desired to make a tooth or barb of a material different from the material of the body of the retainer, such as of a spring metal, the barb may be struck out from a metal strip which is secured to the retainer. FIGS. 28 and 29 illustrate a metal strip 102 having a resilient barb or tooth 103. In FIG. 28, the strip 102 is secured to the retainer 97*a* by flush rivets 104 and 105 and is on the surface of the retainer 97*a*. In FIG. 29, the retainer 97*b* has a groove or channel 106 which receives the strip 102 so that its surface 107 is flush with the surface 108 of the retainer 97*b*.

Although preferred embodiments of the present invention have been described and illustrated, it will be apparent to those skilled in the art that various modifications may be made without departing from the principles of the invention.

I claim:

1. Protecting and sealing means for the open end of a ferrule, said ferrule having a pair of opposed openings through the wall thereof, said protecting and sealing means comprising:

a cup-shaped cap comprising a tubular wall for encircling the portion of said ferrule having said pair of openings therethrough, an end wall closing one end of said tubular wall and a stem projecting from said end wall toward the opposite end of said tubular wall and within said tubular wall; and a retainer insertable through said pair of openings in said ferrule, said retainer being engageable with both said stem and the walls of said pair of openings when said cap is applied over said portion of said ferrule for preventing removal of said cap in the absence of a removing force sufficient to fracture at least one of said cap and said retainer.

2. Protecting and sealing means as set forth in claim 1 wherein said ferrule extends from the key receiving end of a lock.

3. Protecting and sealing means as set forth in claim 1 wherein said cap has at least a portion thereof which is thinner than other portions thereof to define a weakened portion in the cap and hence, a portion for fracture of said cap.

4. Protecting and sealing means as set forth in claim 1 wherein said retainer has at least a portion thereof which is thinner than other portions thereof to define a weakened portion of the retainer and hence, a portion for fracture of said retainer.

5. Protecting and sealing means as set forth in claim 1 further comprising sealing means for surrounding said ferrule and engageable with said tubular wall of said cap for preventing the entry of foreign matter into space between said ferrule and said tubular wall.

6. Protecting and sealing means as set forth in claim 5 wherein said sealing means for surrounding said ferrule is an elastic member.

7. Protecting and sealing means as set forth in claim 6 wherein said sealing means for surrounding said ferrule is an O-ring.

8. Protecting and sealing means as set forth in claim 1 further comprising flexible means interconnecting said cap and said retainer, said flexible means being outside said tubular wall.

9. Protecting and sealing means as set forth in claim 1 wherein said retainer has an opening therethrough for receiving a portion of said stem and wherein said stem has a lip at the end thereof remote from said end wall which is larger than said opening in said retainer and has an enlarged portion which is larger than said opening in said retainer and which is spaced from said lip in the direction of said end wall by at least the thickness of said retainer.

10. Protecting and sealing means as set forth in claim 1 wherein said retainer has a length substantially equal to the diameter of said ferrule, whereby the ends of said retainer are covered by said tubular wall when said cap is applied over said portion of said ferrule, wherein said retainer has a central opening for receiving said stem and wherein said stem has compressible end portion spaced from said end wall to permit said end portion to pass in one direction through said central opening in said retainer, said end portion also having withdrawal resisting means engageable with the side of said retainer which faces away from said end wall for resisting movement of said stem through said central opening in the direction opposite to said one direction.

11. Protecting and sealing means as set forth in claim 10 wherein said central opening in said retainer is circular and wherein said stem is cylindrical at said end portion thereof.

12. Protecting and sealing means as set forth in claim 10 wherein said stem is generally cylindrical and has a diameter which is small relative to the diameter of said tubular wall, wherein said end portion has an axially extending slot and wherein said withdrawal resisting means comprises a lip extending radially outwardly from said end portion of said stem and extending at least part way around said stem.

13. Protecting and sealing means as set forth in claim 12 wherein said stem tapers in diameter from a larger diameter at said lip to a smaller diameter at said end wall.

14. Protecting and sealing means as set forth in claim 10 wherein said end wall has a portion of a thickness in the direction of the axis of said tubular wall which is less than the thickness of another portion of said end wall in the last-mentioned said direction.

15. Protecting and sealing means as set forth in claim 14 wherein said stem projects from said portion of said end wall.

16. Protecting and sealing means as set forth in claim 14 wherein said portion of said end wall is between spaced openings extending through said end wall.

17. Protecting and sealing means as set forth in claim 16 further comprising a clip having an end wall and a pair of arms projecting from a face of said end wall of said clip, said clip being mounted on said end wall of said cap with said end wall of said clip covering said spaced openings extending through said end wall and with said pair of arms extending through the lastmentioned said openings, said arms at the ends thereof remote from the end wall of said clip having teeth engageable with one of said stem and said end wall of said cap for resisting removal of said clip from said cap.

18. Protecting and sealing means as set forth in claim 1 wherein said tubular wall has a pair of openings therethrough which are alignable with said pair of openings in said ferrule, wherein said retainer comprises a pair of parts, one of said parts having teeth which interlock with corresponding teeth on the other of said parts and both said parts having a slot for receiving an end portion of said stem therein, one of said parts being insertable through one of said pair of openings in said tubular wall and one of said pair of openings in said ferrule with said end portion of said stem in the slot therein and the other of each parts being insertable through the other of said pair of openings in said tubular wall and the other of said pair of openings in said ferrule with said end portion of said stem therein and with the teeth of the parts in interlocking engagement so as to resist withdrawal of said parts through said openings in said tubular wall and in said ferrule, said end portion of said stem having withdrawal resisting means engageable with the side of one of said parts which is most remote from said end wall of said cap when said pair of parts have the teeth thereon in interlocking engagement for resisting withdrawal of said cap from said ferrule.

19. Protecting and sealing means as set forth in claim 18 wherein said withdrawal resisting means comprises a lip on said end portion of said stem, said lip having an outer peripheral dimension greater than the width of said slot in the last-mentioned said one of said parts.

20. Protecting and sealing means as set forth in claim 1 wherein said tubular wall has an opening therethrough which is alignable with one of said openings in said ferrule, and wherein said retainer comprises as relatively rigid member insertable through said opening in said tubular wall and said pair of openings in said ferrule.

21. Protecting and sealing means as set forth in claim 20 wherein said relatively rigid member has at least one tooth extending therefrom which permits said member to be inserted through said openings in one direction but resists withdrawal of said member in the opposite direction through said openings.

22. Protecting and sealing means as set forth in claim 21 wherein said member has a slot therein for receiving an end portion of said stem and wherein said end portion of said stem has a lip having an outer peripheral dimension greater than the width of said slot.

23. Protecting and sealing means as set forth in claim 22 wherein said member has a pair of teeth thereon at one end thereof, said teeth extending in opposite directions away from said slot and being engageable with the outer surface of said ferrule.

24. Protecting and sealing means as set forth in claim 23 wherein said tubular wall has a groove therein for receiving said end of said rigid member.

25. Protecting and sealing means as set forth in claim 22 wherein said tubular wall has a further opening therethrough alignable with the other of said openings in said ferrule, wherein said member is insertable at one end thereof through said further opening of said tubular wall and has a pair of teeth thereon at said end thereof, said teeth extending in opposite directions away from said slot and being engageable with the outer surface of said tubular wall.

26. Protecting and sealing means as set forth in claim 21 wherein said stem has an opening therethrough alignable with said pair of openings in said ferrule and wherein said member is also insertable through said opening in said stem.

27. Protecting and sealing means as set forth in claim 26 wherein said tubular wall has a further opening therethrough alignable with the other of said openings in said ferrule and wherein said member is insertable through said further opening.

28. Protecting and sealing means as set forth in claim 20 wherein said stem has a pair of arcuate portions coaxial with said tubular wall and having an exterior dimension less than the interior dimension of said ferrule, each of said arcuate portions having an opening alignable with said pair of openings in said ferrule and wherein said member is insertable through said opening of each of said arcuate portions.

29. Protecting and sealing means as set forth in claim 28 wherein said arcuate portions are portions of a tube.

30. Protecting and sealing means as set forth in claim 1 wherein said retainer has at least one tooth thereon which permits said retainer to pass through one of said openings in said ferrule in a first direction but resists passage of said retainer through said one of said openings in said ferrule in a second, opposite direction.

31. Protecting and sealing means as set forth in claim 30 wherein said tooth is flexible and resilient and extends outwardly from a surface of said retainer and wherein said retainer has a cavity therein for receiving said tooth when it is pressed toward said retainer.

32. Protecting and sealing means as set forth in claim 30 wherein said tooth is made of a material different from the material of said retainer and is secured to said retainer.

33. Protecting and sealing means as set forth in claim 32 wherein said tooth is struck out from a strip secured to said retainer and wherein said strip has an opening therein for receiving said tooth when it is pressed toward said retainer.

34. Protecting and sealing means as set forth in claim 1 wherein said ferrule extends from the receiving end of securing means.

* * * * *